US008766143B2

(12) United States Patent
Berger et al.

(10) Patent No.: US 8,766,143 B2
(45) Date of Patent: Jul. 1, 2014

(54) METHOD FOR OPERATING A COOKING APPLIANCE AND DEVICE FOR CARRYING OUT SAID METHOD

(75) Inventors: Uwe Berger, Kirchlengern (DE); Hartmut Dittrich, Buende (DE); Ruediger Hoehn, Hiddenhausen (DE)

(73) Assignee: Miele & Cie. KG, Guetersloh (DE)

( * ) Notice: Subject to any disclaimer, the term of this patent is extended or adjusted under 35 U.S.C. 154(b) by 1271 days.

(21) Appl. No.: 10/597,850

(22) PCT Filed: Jan. 24, 2005

(86) PCT No.: PCT/EP2005/000644

§ 371 (c)(1),
(2), (4) Date: Aug. 9, 2006

(87) PCT Pub. No.: WO2005/078352

PCT Pub. Date: Aug. 25, 2005

(65) Prior Publication Data

US 2008/0148960 A1 Jun. 26, 2008

(30) Foreign Application Priority Data

Feb. 12, 2004 (DE) ..... 10 2004 007 122

(51) Int. Cl.
*A47J 37/00* (2006.01)
*G05D 23/19* (2006.01)

(52) U.S. Cl.
USPC ..... 219/412; 126/21 A

(58) Field of Classification Search
USPC ..... 99/293 R, 329 R, 325–329, 337, 99/331–334; 126/3, 4, 5, 6, 190, 273 R, 126/273 A; 219/393, 413, 401
See application file for complete search history.

(56) References Cited

U.S. PATENT DOCUMENTS 2,907,859 A 10/1959 Walkoe
2,944,540 A 7/1960 Littell, Jr.
(Continued)

FOREIGN PATENT DOCUMENTS

DE 40 19 411 12/1991
DE 43 38 584 5/1995
(Continued)

OTHER PUBLICATIONS

International Search Report for PCT International Application No. PCT/EP2005/000644 dated Apr. 18, 2005.

*Primary Examiner* — Brian Jennison
(74) *Attorney, Agent, or Firm* — Leydig, Voit & Mayer, Ltd.

(57) ABSTRACT

A method for operating a cooking appliance having a cooking appliance control system and a door. The method includes automatically opening the door using the cooking appliance control system when a cooking process is complete, and automatically closing the door when a physical quantity falls below a predetermined threshold value stored in a memory of the cooking appliance control system. In addition, a cooking appliance includes a cooking chamber, a door, a cooking appliance control system having a memory, a sensor disposed in the cooking chamber, a guide device, and a door opening device including a positioning motor and a rod. The cooking appliance control system is configured to actuate the positioning motor as a function of the output signal so as to automatically open the door when a cooking process is complete and automatically close the door when a physical quantity falls below a predetermined threshold value.

7 Claims, 1 Drawing Sheet

(56) References Cited

U.S. PATENT DOCUMENTS

| | | | | |
|---|---|---|---|---|
| 3,845,272 | A | 10/1974 | Schultz et al. | |
| 4,397,508 | A | 8/1983 | Bohnet et al. | |
| 4,450,335 | A * | 5/1984 | Shimizu et al. | 219/723 |
| 5,012,794 | A * | 5/1991 | Faurel | 126/197 |
| 2003/0010221 | A1* | 1/2003 | Berger et al. | 99/476 |
| 2004/0027248 | A1* | 2/2004 | Lile | 340/628 |
| 2004/0231524 | A1* | 11/2004 | Kuttalek | 99/357 |

FOREIGN PATENT DOCUMENTS

| | | |
|---|---|---|
| DE | 295 14 690 | 2/1996 |
| DE | 100 27 774 | 11/2001 |
| JP | 09/033051 | 2/1997 |
| WO | WO-00/52392 | 9/2000 |

* cited by examiner

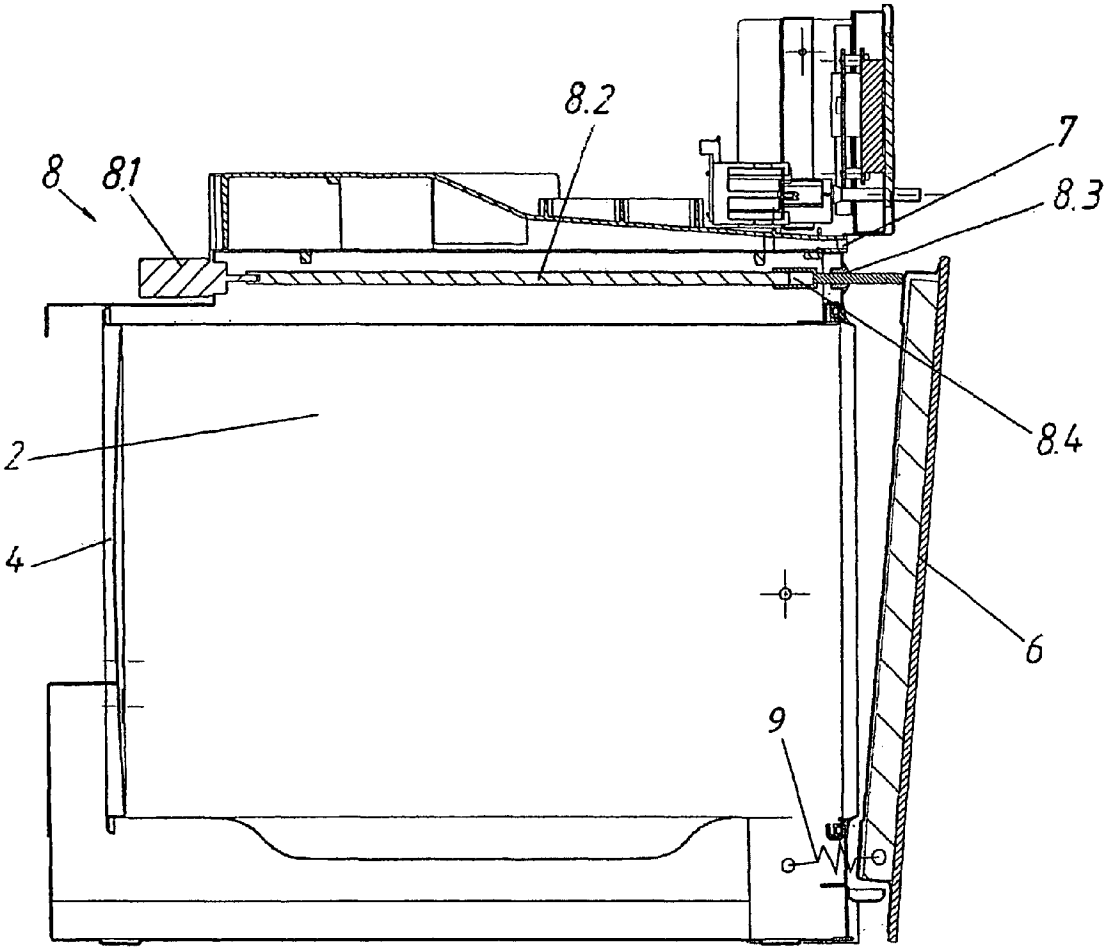
7
8.3
8.4
6
9
8.2
8.1
8
2
4

METHOD FOR OPERATING A COOKING APPLIANCE AND DEVICE FOR CARRYING OUT SAID METHOD

CROSS-REFERENCE TO PRIOR APPLICATION

This application is a U.S. National Phase of International Patent Application PCT/EP2005/000644, filed Jan. 24, 2005, which claims priority to German Application No. 10 2004 007 122.5, filed Feb. 12, 2004, which is incorporated by reference herein. The International application was published in German on Aug. 25, 2005 as WO 2005/078352 A1.

FIELD OF THE INVENTION

The present invention relates to a method for operating a cooking appliance and a device for carrying out the method.

BACKGROUND

Such a method and a device for carrying out the method are known, for example, from DE 40 19 411 A1. To carry out the known method, the cooking appliance includes a cooking chamber, which is bounded by a housing and a door in its closed position, and further includes a cooking appliance control system, the door being automatically openable by the cooking appliance control system by means of a door opening device. The known door opening device is composed of an electromagnetic lock which is mounted on the housing and includes a piston return spring, a positioning piston mounted on the door, and a door seal. When the door is closed, i.e., when the door is in its closed position, the door seal is biased and the positioning piston is locked in place by the electromagnetic lock. According to the known method, the door is automatically opened by the known door opening device when a presettable timer disposed in the appliance control system has expired. To this end, electromagnetic lock is actuated in such a way that the positioning piston is released. The door opens automatically because of the bias of the door seal and because of the piston return spring.

A similar cooking appliance is known from DE 100 27 774 C2. In that cooking appliance, the rod can be automatically reciprocated by the appliance control system by means of the positioning motor such a manner that the door can be automatically moved from its closed position to a predetermined open position and vice versa. This is done using a sensor in the form of a temperature sensor. In the known cooking appliance, the door is automatically moved from the closed position to the open position after a cooking process in the form of a baking process is complete. The heat and vapor can gradually escape from the cooking chamber through the gap between the door and the housing.

Furthermore, DE 295 14 690 U1 discloses the use of a shape-memory element in an automatic venting device to automatically open a window.

Furthermore, it is known from DE 43 38 584 A1 to use a return element in the form of a spring in a device for thermally treating materials in order to sealingly close a heating chamber that can be closed by a door. There, the spring is mounted on a hinge rod of a hinge-type mounting arrangement of the door.

SUMMARY OF THE INVENTION

It is an object of the present invention to further improve the ease of use for the user.

The present invention provides a method for operating a cooking appliance including a cooking chamber, which is bounded by a housing and a door in its closed position, and further including a cooking appliance control system, the door being automatically openable by the cooking appliance control system by means of a door opening device, the door being automatically moved from the closed position to the open position when the cooking process is complete, wherein, after the aforementioned movement to the open position, the door is automatically returned to the closed position when a physical quantity falls below a predetermined threshold value stored in a memory of the cooking appliance control system.

In addition to the improved user convenience provided by automatically moving the door from the closed position to the open position when the cooking process is complete, and by automatically returning the door to the closed position after a physical quantity falls below a predetermined threshold value stored in the memory of the cooking appliance control system, a particular advantage that can be achieved with the present invention is that the door does not undesirably remain in the open position after the excess heat and/or the excess vapor has/have escaped. Thus, in addition to the fact that the automatic opening of the door prevents the cooking process from being undesirably continued, which would be disadvantageous for the cooking result, the food to be cooked is prevented from cooling and/or drying to an extent that would also be disadvantageous for the cooking result, because the door remains in the open position.

A further or alternate object of the present invention is to provide a device for carrying out the method of the present invention.

The present invention also provides a cooking appliance, in particular a steam cooking appliance, comprising a cooking chamber which is bounded by a housing and a door in its closed position, and further comprising a cooking appliance control system, the door being automatically openable by the cooking appliance control system by means of a door opening device, the door opening device including a positioning motor and a rod, and the rod being capable of being automatically reciprocated by the cooking appliance control system by means of the positioning motor such a manner that the door can be automatically moved from its closed position to a predetermined open position and vice versa, the cooking appliance control system actuating the positioning motor as a function of the output signal of a sensor located in the cooking chamber, and the cooking appliance control system actuating the positioning motor in such a manner that the door is automatically moved from the closed position to the open position when the cooking process is complete, wherein the rod can be reciprocated in a guide means, and the cooking appliance control system actuates the positioning motor in such a manner that the door is automatically returned to the closed position when a physical quantity falls below a predetermined threshold value stored in the memory Advantageous embodiments and refinements of the present invention will become apparent from the claims.

One particular advantage that can be achieved with the present invention is the structurally simple and thus rugged implementation of a cooking appliance according to the present invention. Another advantage of the device according to the present invention is that, apart from the door opening device, no additional components, such as venting ducts and valves, are needed.

In accordance with the teaching of the present invention, the cooking appliance control system actuates the positioning motor as a function of the output signal of a sensor located in the cooking chamber. Thus, the automatic movement of the door from the closed position to the open position, and vice versa, can be adapted even more effectively to the actual conditions in the cooking chamber.

Moreover, the automatic movement of the door from the closed position to the open position, and vice versa, is thereby implemented in a simple manner.

In a particularly advantageous refinement of the teaching of the present invention, the positioning motor takes the form of an electrically heatable shape-memory element. This allows the teaching of the present invention to be implemented in a particularly simple and therefore inexpensive manner.

In another advantageous embodiment, the returning of the door from the open position to the closed position is aided by a return element which is disposed between the door and the housing and is in force-transmitting connection with the door and the housing. This further simplifies the structural design, because return elements of this type, such as springs or the like, are generally part of conventional cooking appliances.

In yet another advantageous embodiment, a spring means or a damping means is mounted on the rod in such a manner that the movement of the door from the closed position to the open position, or vice versa, is retarded. In this manner, manufacturing and assembly tolerances occurring in the manufacture of cooking appliances are compensated for with structurally simple means. Furthermore, this allows the door to be moved from the closed position to the open position, and vice versa, in a manner that helps prevent damage to the material. In addition, this allows for a significant reduction of unwanted sounds when moving the door to the open position or to the closed position.

BRIEF DESCRIPTION OF THE DRAWING

An exemplary embodiment of the present invention is shown in the only drawing FIGURE in a purely schematic way and will be described in more detail below.

The FIGURE is a cross-sectional side view of a cooking appliance according to the present invention.

DETAILED DESCRIPTION

In the FIGURE, there is shown a cooking appliance in the form of a steam cooking appliance for carrying out the method of the present invention. The cooking appliance has a cooking chamber 2, which is bounded by a housing 4 and a door 6 in its closed position. In the FIGURE, door 6 is shown in its open position. Door 6 is held to housing 4 in a conventional manner by a hinge, which is mounted on housing 4 and located in the lower portion of housing 4 when the cooking appliance is in the operating position. The hinge allows door 6 to pivot to a position approximately horizontal with respect to the operating position. The hinge has a return element 9, which takes the form of a return spring and is in force transmitting connection with housing 4 and door 6. The return element aids in moving door 6 toward the closed position. In the present exemplary embodiment, the cooking appliance of the present invention has a fan, which sucks out vapors from cooking chamber 2 and discharges the vapors into the open environment mainly through a flow channel and an outlet 7 which is provided on the front of the cooking appliance and located above door 6 when the cooking appliance is in the operating position.

Door opening device 8 includes a positioning motor 8.1 in the form of an electrically heatable shape-memory element, a rod 8.2, and a guiding means 8.3 for rod 8.2. Rod 8.2 can be automatically reciprocated in guide means 8.3 by the cooking appliance control system by means of positioning motor 8.1 in such a manner that door 6 can be automatically moved from its closed position to the predetermined open position, and vice versa. In the present exemplary embodiment, the open position shown in the FIGURE is defined such that door 6 is open approximately 1 degree in the open position. Rod 8.2 is designed in two parts, a spring means or damping means 8.4, for example, in the form of a spiral spring, being arranged between the two parts of rod 8.2. Spring or damping means 8.4 is inserted in a sleeve-like receptacle on one part of rod 8.2. The other part of rod 8.2 engages, with one end, in the sleeve-like receptacle and is movably guided in the sleeve-like receptacle. At the same time, spring or damping means 8.4 is thereby held in place. Apart from that, the above-mentioned components of door opening device 8 are force-transmittingly connected to each other in a manner known to those skilled in the art.

Door opening device 8 includes a positioning motor 8.1 in the form of an electrically heatable shape-memory element, a rod 8.2, and a guiding means 8.3 for rod 8.2. Rod 8.2 can be automatically reciprocated in guide means 8.3 by the cooking appliance control system by means of positioning motor 8.1 in such a manner that door 6 can be automatically moved from its closed position to the predetermined open position, and vice versa. In the present exemplary embodiment, the open position shown in the FIGURE is defined such that door 6 is open approximately 1 degree in the open position. Rod 8.2 is designed in two parts, a spring means 8.4 in the form of a spiral spring being arranged between the two parts of rod 8.2. Spring means 8.4 is inserted in a sleeve-like receptacle on one part of rod 8.2. The other part of rod 8.2 engages, with one end, in the sleeve-like receptacle and is movably guided in the sleeve-like receptacle. At the same time, spring means 8.4 is thereby held in place. Apart from that, the above-mentioned components of door opening device 8 are force-transmittingly connected to each other in a manner known to those skilled in the art.

In the following, the operation of the cooking appliance of the present invention, and thus of the method according to the present invention, will be explained in greater detail with reference to the FIGURE.

The cooking appliance is on, food to be cooked is placed in cooking chamber 2, and door 6 is in the closed position, so that cooking chamber 2 is closed in a substantially sealing manner. The completion of the cooking process is detected by the cooking appliance control system in a manner known to those skilled in the art, for example, based on the signal of a timing element in the cooking appliance control system, or by means of a sensor located in cooking chamber 2. Once the cooking appliance control system has detected the completion of the cooking process, the electrical heater of positioning motor 8.1, which is in the form of a shape-memory element, is connected to an electrical voltage, so that the shape-memory material, which is wax in this exemplary embodiment, expands, moving a plunger of positioning motor 8.1 out of the housing of positioning motor 8.1 and toward door 6, substantially along the longitudinal axis of rod 8.2. Since one part of rod 8.2 is force-transmittingly connected to the plunger of positioning motor 8.1, this part of rod 8.2 also moves toward door 6 substantially along the longitudinal axis of rod 8.2, which is guided in guide means 8.3. In the process, spring means 8.4 is initially slightly compressed along the longitudinal axis of rod 8.2 before the force introduced by the expanding wax is transmitted by said spring means to the other part of rod 8.2. Once the other part of rod 8.2 is in force-transmitting connection with door 6 and the spring force of the return element is overcome, door 6 is moved by door opening device 8 from the closed position to the open position and retained therein against the spring force of the return element.

When door 6 is in the open position, excess heat and/or vapor can escape from cooking chamber 2 into the open environment, so that cooking chamber 2 cools down. In accordance with the present exemplary embodiment, in order to accelerate this process, the cooking appliance control system leaves the fan on, or turns the fan on, after the cooking process is complete, so that a flow of air or vapors emerging from outlet 7 above door 6 promotes the exchange of air in cooking chamber 2.

The cooking chamber temperature is measured by the temperature sensor located in cooking chamber 2 during the entire processes explained above, and thereafter, converted into an output signal, and transmitted to the processing unit of the cooking appliance control system. When, after door 6 has been opened, the cooking chamber temperature measured by the temperature sensor falls below the predetermined threshold value stored in the memory of the cooking appliance control system, the electrical heater of positioning motor 8.1, which is in the form of a shape-memory element, is de-energized, the wax contracts, and the plunger of positioning motor 8.1 is moved substantially along the longitudinal axis of rod 8.2 in the opposite direction, i.e., away from door 6. The automatic return of door 6 from the open position to the closed position takes place analogously to the above-described movement from the closed position to the open position, but in the opposite direction. Unlike the previous case, the movement of door 6 from the open position back to the closed position is assisted by the return element.

The invention is not limited to the exemplary embodiment described above. For example, it is possible to use a positioning motor in the form of an electric motor or a solenoid, or to use other shape-memory materials. In addition to using temperature as the physical quantity, as in the illustrated exemplary embodiment, it is also possible to use other physical quantities, such as relative humidity or time, depending on whether the physical quantity is measured in or on the cooking chamber by sensor means, or whether the reaching of the threshold value is calculated based on data stored in the memory of the cooking appliance control system. This data may be determined in advance in a series of experiments. Moreover, it is conceivable that the threshold value of the physical quantity used may be predetermined, for example, depending on the food to be cooked and/or on the type of cooking process. Furthermore, it is possible to use a damping means instead of the spring means.

What is claimed is:

1. A method for operating a cooking appliance having a cooking appliance control system and a door moveable between a closed position and an open position relative to a cooking chamber, the method comprising:

automatically moving the door from the closed position to the open position using the cooking appliance control system in response to a first signal indicative of a completion of a cooking process based on at least one of the exhaustion of a cooking time and a sensor signal provided by at least one of a temperature sensor and a humidity sensor disposed in the cooking chamber; and automatically returning the door from the open position to the closed position in response to a second signal indicative of a physical quantity including at least one of temperature and humidity in the cooking chamber falling below a predetermined threshold value stored in a memory of the cooking appliance control system, wherein the first signal and the second signal are different.

2. A cooking appliance comprising:

a cooking chamber bounded by a housing;

a door moveable between a closed position and a predetermined open position;

a cooking appliance control system having a memory;

a sensor disposed in the cooking chamber configured to send an output signal to the cooking appliance control system;

a guide device; and a door opening device including a positioning motor and a rod configured to be automatically reciprocated in the guide device by the cooking appliance control system via the positioning motor so as to automatically move the door from the closed position to the predetermined open position and from the predetermined open position to the closed position, the cooking appliance control system configured to actuate the positioning motor so as to automatically move the door from the closed position to the predetermined open position in response to a first signal indicative of a completion of a cooking process based on at least one of the exhaustion of a cooking time and the output signal from the sensor and to actuate the positioning motor so as to automatically return the door to the closed position when a second signal is indicative of a physical quantity including at least one of temperature and humidity in the cooking chamber has fallen below a predetermined threshold value stored in the memory, wherein the first signal and the second signal are different.

3. The cooking appliance as recited in claim 2, wherein the cooking appliance is a steam cooking appliance.

4. The cooking appliance as recited in claim 2, wherein the positioning motor includes an electrically heatable shape-memory element.

5. The cooking appliance as recited in claim 2, further comprising a return element disposed between the door and the housing, wherein the return element is in force-transmitting connection with the door and the housing and is configured to aid the return of the door from the predetermined open position to the closed position.

6. The cooking appliance as recited claim 2, further comprising at least one of a spring device and a damping device mounted on the rod and configured to retard a movement of the door from the closed position to the predetermined open position.

7. The cooking appliance as recited claim 2, further comprising at least one of a spring device and a damping device mounted on the rod and configured to retard a movement of the door from the predetermined open position to the closed position.

* * * * *